US011274875B2

(12) United States Patent
Chen et al.

(10) Patent No.: US 11,274,875 B2
(45) Date of Patent: Mar. 15, 2022

(54) REFRIGERATOR

(71) Applicant: QINGDAO HAIER CO., LTD., Qingdao (CN)

(72) Inventors: Jianquan Chen, Qingdao (CN); Chun Yang, Qingdao (CN); Hao Zhang, Qingdao (CN); Enpin Xia, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 42 days.

(21) Appl. No.: 16/771,664

(22) PCT Filed: Dec. 7, 2018

(86) PCT No.: PCT/CN2018/119779
§ 371 (c)(1),
(2) Date: Jun. 10, 2020

(87) PCT Pub. No.: WO2019/114628
PCT Pub. Date: Jun. 20, 2019

(65) Prior Publication Data

US 2020/0393193 A1 Dec. 17, 2020

(30) Foreign Application Priority Data

Dec. 11, 2017 (CN) ..... 201711308454.5

(51) Int. Cl.
*F25D 23/10* (2006.01)
*F25D 23/06* (2006.01)

(52) U.S. Cl.
CPC ..... *F25D 23/10* (2013.01); *F25D 23/065* (2013.01); *F25B 2500/12* (2013.01); *F25D 2201/30* (2013.01)

(58) Field of Classification Search
CPC .... F25D 23/10; F25D 23/065; F25D 2201/30; F25D 17/042; F25D 2317/043; F25B 2500/12; F04B 39/0061; F04B 39/0033
USPC ..... 62/296
See application file for complete search history.

(56) References Cited

FOREIGN PATENT DOCUMENTS

| | | | | |
|---|---|---|---|---|
| CN | 101342970 | A | | 1/2009 |
| CN | 101886624 | A | * | 11/2010 |
| CN | 204152751 | U | | 2/2015 |
| CN | 204783530 | U | | 11/2015 |
| CN | 106288263 | A | | 1/2017 |
| CN | 106593818 | A | | 4/2017 |
| CN | 106593820 | A | | 4/2017 |
| CN | 206290403 | U | | 6/2017 |

(Continued)

*Primary Examiner* — Steve S Tanenbaum
(74) *Attorney, Agent, or Firm* — Cheng-Ju Chiang

(57) ABSTRACT

A sound-insulating refrigerator vacuum assembly, comprising a sealed box receiving a vacuum pump, the sealed box body comprises an upper sealing body and a lower sealing body, the upper sealing body and the lower sealing body can be snap-fitted to define a receiving cavity, and the vacuum pump is placed in the receiving cavity; the vacuum assembly further comprises an air pipe member, the air pipe member comprises an air inlet pipe, an air outlet pipe and a base plate that are integrally formed, and the air inlet pipe and the air outlet pipe are disposed through the base plate; a notch portion is provided in the sealed box, and an outer edge of the base plate matches the notch portion in shape; the vacuum pump is connected with a muffler.

9 Claims, 9 Drawing Sheets

(56) References Cited

FOREIGN PATENT DOCUMENTS

| | | | |
|---|---|---|---|
| CN | 206449967 | U | 8/2017 |
| CN | 108131277 | A | 6/2018 |
| CN | 108150388 | A | 6/2018 |
| CN | 108195126 | A | 6/2018 |
| CN | 108253701 | A | 7/2018 |
| FR | 2703403 | B1 | 7/1995 |
| KR | 2003-0080277 | A | 10/2003 |

* cited by examiner

REFRIGERATOR

This application is a 35 U.S.C. § 371 National Phase conversion of International (PCT) Patent Application No. PCT/CN2018/119779, filed on Dec. 7, 2018, which claims the priority of Chinese patent application, the filing date of which is Dec. 11, 2017, the application number is 201711308454.5, and the title of invention is "vacuum pump with integrated air pipe assemble and refrigerator", the entire contents of which are incorporated herein by reference in its entirety. The PCT International Patent Application was filed and published in Chinese.

TECHNICAL FIELD

The present invention relates to the technical field of noise reduction of refrigeration apparatus, and specifically to a muffler for reducing noise of a vacuum pump.

BACKGROUND

Freshness of food in a refrigerator is closely related to temperature, humidity and gas environment, wherein oxygen is an important factor causing spoilage, deterioration and bacteria multiplication of the food. A preservation period of the food may be significantly prolonged by pumping oxygen in the compartment to control a nitrogen-to-oxygen ratio of the refrigerator.

Oxygen may be pumped out from a specific space via a vacuum pump, and discharged outside the refrigerator. However, when gas, as a medium for conducting a sound, conducts noise in the refrigerator to an external space of the refrigerator during the discharge, thereby causing noise interference.

SUMMARY

An object of the present invention is to provide a sealing device to solve the problem of noise output of the box body.

To achieve the object, the present invention provides a sound-insulating refrigerator vacuum assembly, comprising a sealed box receiving a vacuum pump, wherein the sealed box body comprises an upper sealing body and a lower sealing body, the upper sealing body and the lower sealing body can be snap-fitted to define a receiving cavity, and the vacuum pump is placed in the receiving cavity; the vacuum assembly further comprises an air pipe member, the air pipe member comprises an air inlet pipe, an air outlet pipe and a base plate that are integrally formed, and the air inlet pipe and the air outlet pipe are disposed through the base plate; a notch portion is provided in the sealed box, and an outer edge of the base plate matches the notch portion in shape; the vacuum pump is connected with a muffler.

A further improvement as an embodiment of the present invention, a sealing unit is disposed between the notch portion and the base plate.

A further improvement as an embodiment of the present invention, a flange is provided on a peripheral edge of the notch portion, a groove is provided on the outer edge of the base plate, and the flange mates with the groove.

A further improvement as an embodiment of the present invention, the sealing unit is disposed is a fitting gap between the flange and the groove.

A further improvement as an embodiment of the present invention, the sealing unit is made of an elastic material.

A further improvement as an embodiment of the present invention, the sealing unit is ring-shaped.

A further improvement as an embodiment of the present invention, the muffler comprises a hollow cavity enclosed by a first bottom surface, a second bottom surface and a side wall, the side wall is connected with the first bottom surface and the second bottom surface, the muffler is provided with an air inlet at one end and with an air outlet at the other end, the cavity is divided into a plurality of chambers in an axial direction, the chambers comprise a first chamber adjacent to the first bottom surface, a second chamber adjacent to the second bottom surface and an intermediate chamber between the first chamber and the second chamber, the air inlet is in gas communication with the intermediate chamber, the intermediate chamber is in gas communication with the second chamber, the first chamber is in gas communication with the second chamber, and the air outlet is in gas communication with the first chamber.

A further improvement as an embodiment of the present invention, the muffler comprises a hollow cavity enclosed by a first bottom surface, a second bottom surface and a side wall, the side wall is connected with the first bottom surface and the second bottom surface, the first bottom surface is provided with an air inlet, the second bottom surface is provided with an air outlet, a first duct is communicated with the air inlet and the cavity, a second duct is communicated with the cavity and the air outlet, a distal end of the first duct is adjacent to the second bottom surface, and a proximal end of the second duct is adjacent to the first bottom surface.

A further improvement as an embodiment of the present invention, the muffler comprises a housing and a duct provided in the housing, the housing is enclosed to form a hollow cavity, the housing is provided with an air inlet at a proximal end and with an air outlet at a distal end, the duct communicates with the air inlet and the air outlet, the duct is filled with a medium, and a plurality of through holes are defined in the side wall of the duct to communicate the duct with the cavity.

To achieve the object, the present invention provides a refrigerator comprising a cabinet, a fresh-keeping space being provided in the cabinet, wherein the refrigerator further comprises the vacuum assembly according to above, and the vacuum assembly is connected with the fresh-keeping space.

To achieve the object, the present invention provides a muffler comprises a housing enclosed to form a hollow cavity, the cavity comprises a cylindrical chamber and a rectangular parallelepiped chamber, wherein one of bottom surfaces of the cylindrical chamber is connected with a first surface of the rectangular parallelepiped chamber, the cylindrical chamber communicates with an interior of the rectangular parallelepiped chamber, and the cylindrical chamber is provided with an air inlet and an air outlet.

A further improvement as an embodiment of the present invention, a diameter of the bottom surface of the cylindrical chamber is smaller than or equal to a length of a side of the first surface.

A further improvement as an embodiment of the present invention, the air inlet and the air outlet are arranged at an angle.

A further improvement as an embodiment of the present invention, the air inlet is provided on the bottom surface of the cylindrical chamber, and the air outlet is provided on a side of the cylindrical chamber.

A further improvement as an embodiment of the present invention, inner diameters of the air inlet and the air outlet are the same.

To achieve the object, the present invention provides a refrigerator vacuum assembly comprising a sealed box the sealed box comprises an upper sealing body and a lower sealing body, and the upper sealing body and the lower sealing body can be snap-fitted to define a receiving cavity; a vacuum pump is arranged in the receiving cavity, and the vacuum pump is connected with the muffler according to any one of claims 1-5.

A further improvement as an embodiment of the present invention, further comprises an air outlet pipe passing through the sealed box, the air inlet of the muffler is connected with the vacuum pump, and the air outlet is connected with the air outlet pipe.

A further improvement as an embodiment of the present invention, a notch portion is provided where the upper sealing body engages the lower sealing body, the vacuum assembly further comprises a seal capable of being embedded in the notch portion, the seal comprises a snap-fittable portion which is composed of two H-shaped members that are flexibly connected, the two H-shaped members can be snap-fitted to each other to form a mounted state, and the H-shaped member has a first arm and a second arm which are parallel to each other, and a connecting portion connecting the first arm with the second arm, the connecting portion has an arc-shaped surface, and arc-shaped surfaces of the two H-shaped members jointly enclose to form a hollow cavity when the H-shaped members are in the mounted state.

A further improvement as an embodiment of the present invention, the two H-shaped members, in the mounted state, match the notch portion in shape.

To achieve the object, the present invention provides a refrigerator, comprising a sealed box receiving a vacuum pump, wherein the refrigerator further comprises the muffler according to claim 1, and the muffler is disposed in the sealed box and connected with the vacuum pump.

As compared with the prior art, the refrigerator vacuum assembly provided by the present invention achieves sound insulation by inserting and fixing plate-like members, and prevents vibrational noise of the vacuum pump from being conducted through the sealed box body.

DETAILED DESCRIPTION

The present invention will be described in detail in conjunction with specific embodiments shown in the figures. However, these embodiments are not limited to the present invention. Variations in terms of structure, method or function made by those having ordinary skill in the art according to these embodiments are all comprised in the scope of the present invention.

Terms indicating positions and directions described in the present invention all take a vacuum pump as a reference. An end close to the vacuum pump is a proximal end, and an end away from the vacuum pump is a distal end.

Figure 1:
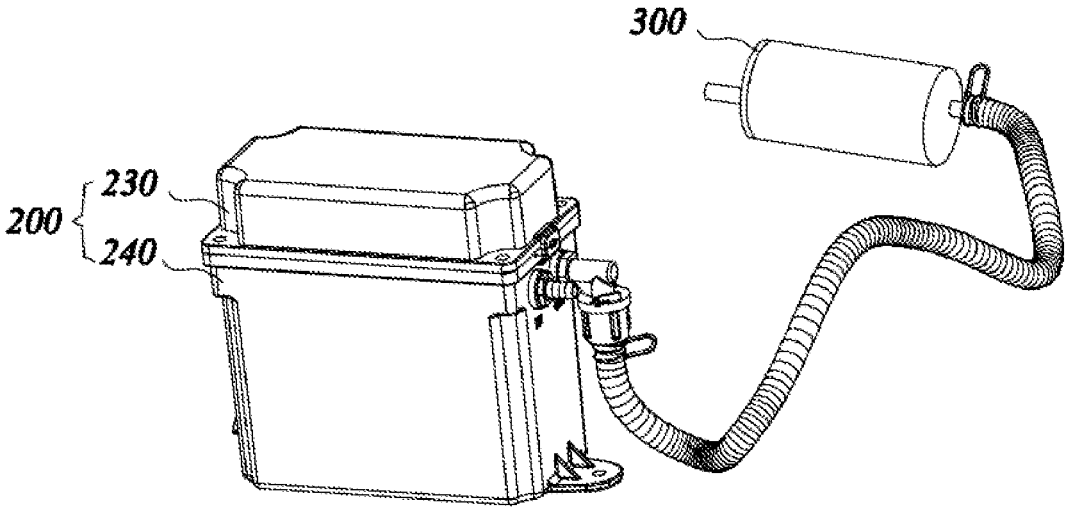
FIG. 1 is a schematic structural diagram of a sealed box according to an embodiment of the present invention.
Figure 2:
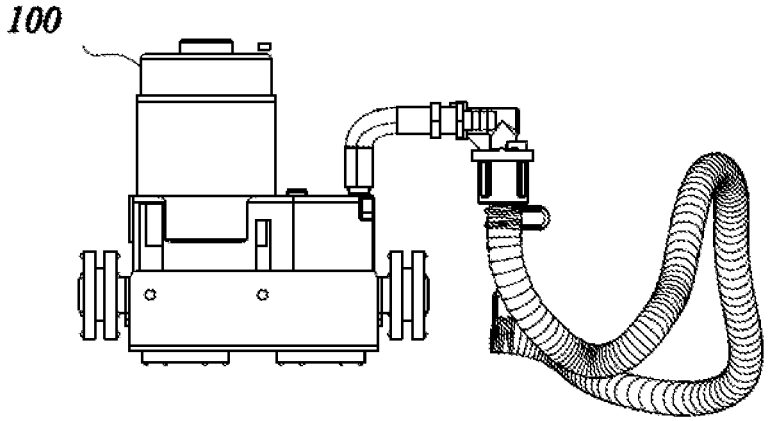
FIG. 2 is a schematic diagram of components inside and outside a sealed box according to an embodiment of the present invention.
Figure 3:
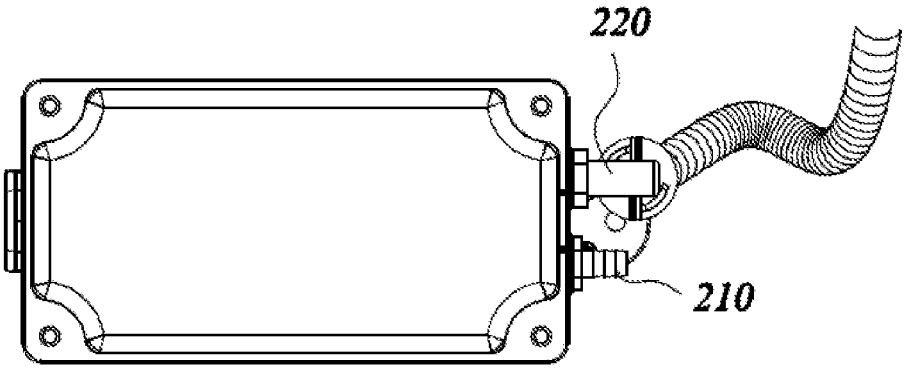
FIG. 3 is a top view of a sealed box according to an embodiment of the present invention.

Referring to FIG. 1 through FIG. 3, in an embodiment of the present invention, a vacuum pump 100 is received in a sealed box 200, and communicated with ambient air through an air inlet pipe 210 and an air outlet pipe 220. A proximal end of the air inlet pipe 210 is communicated with an air intake line of the vacuum pump 100, and a distal end is communicated with a fresh-keeping space in the refrigerator compartment (not shown); a proximal end of the air outlet pipe 220 is communicated with an air exhaust line of the vacuum pump 100, and a distal end extends towards outside the sealed box 200. The sealed box 200 blocks air communication between the vacuum pump 100 and an installation environment, and achieves an effect of sound insulation. The fresh-keeping space may be either an independent compartment or a closed or semi-closed space located in a portion of the refrigerator compartment.

The sealed box 200 comprises an upper sealing body 230 and a lower sealing body 240. The upper sealing body 230 comprises a top wall and side walls which are integrally formed and jointly define a receiving cavity with a lower end opening. The lower sealing body 240 comprises a bottom wall and side walls which are integrally formed and jointly define a receiving cavity with an upper end opening. The opening of the upper sealing body 230 and the opening of the lower sealing body 240 match each other, and snap fit each other to form a receiving space of the vacuum pump 100.

Preferably, the upper sealing body 230 and the lower sealing body 240 are made of plastic.

Figure 4:
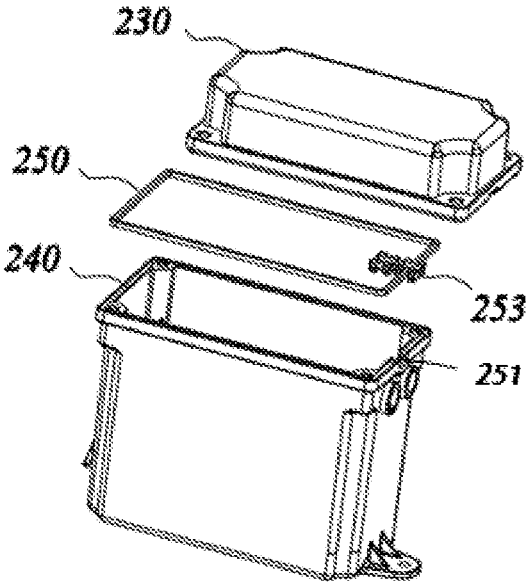
FIG. 4 is an exploded schematic view of a sealed box according to an embodiment of the present invention.

Referring to FIG. 4, a seal is provided between the upper sealing body 230 and the lower sealing body 240. A first groove is formed at a lower edge of the side walls of the upper sealing body 230, a second groove is formed at an upper edge of the side walls of the lower sealing body 240, and the first groove matches with the second groove to form a mounting groove for a gasket ring 250. In this way, the airtightness can be ensured after the upper sealing body 230 and the lower sealing body 240 are snap fitted, and sound can be prevented from being transmitted outside through a splicing gap of the sealed box 200. The gasket ring 250 is ring-shaped and has a circular cross-section. The gasket ring 250 is made of an elastic material, and has a mounting tension amount 2-5% when embedded in the mounting groove. When the upper sealing body 230 and the lower sealing body 240 are snap-fitted, a pressure is applied to the gasket ring 250 to form a 20-30% compression amount, thereby ensuring the sealing effect.

Figure 5:
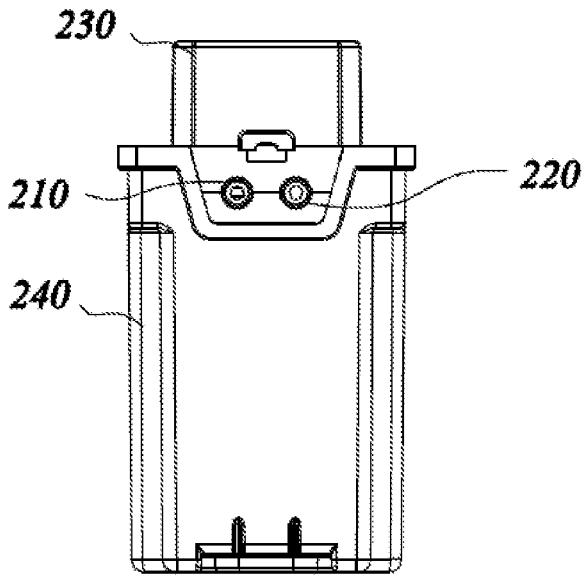
FIG. 5 is a front view of a sealed box body according to an embodiment of the present invention.

FIG. 4 and FIG. 5 show that a notch portion 251 is provided at where the upper sealing body 230 and the lower sealing body 240 are engaged, and allows a wire connected to the vacuum pump 100 to pass through. In order to ensure the sealing performance of the sealed box 200, a snap-fittable sealing ring 253 is provided at the notch portion 251. The sealing ring 253 is made of an elastic material and integrally formed with the gasket ring 250.

Figure 6:
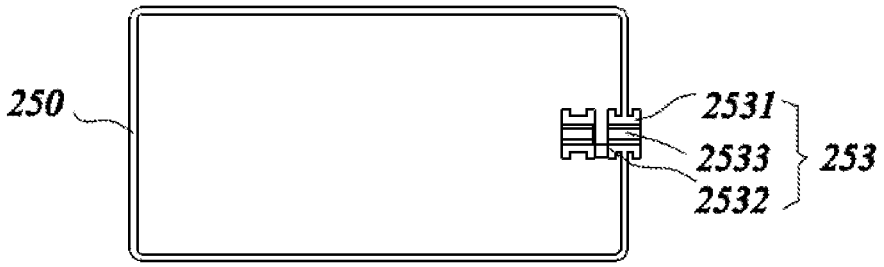
FIG. 6 is a top view of a seal in an embodiment of the present invention.
Figure 7:
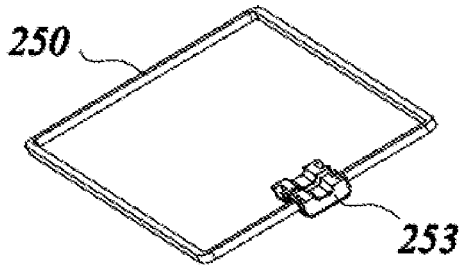
FIG. 7 is a schematic structural diagram of a seal in an embodiment of the present invention.

Referring to FIG. 6 and FIG. 7, the sealing ring 253 is composed of two H-shaped members that are flexibly connected, and the H-shaped members can be snap-fitted to each other to form a mounted state that cooperates with the notch portion 251. The H-shaped member has a first arm 2531 and a second arm 2532 parallel to each other, and a connecting portion 2533 connecting the first arm 2531 with the second arm 2532. The first arm 2531 and the second arm 2532 can cooperate to clamp the side wall of the box body at the edge of the notch portion 251 therebetween to prevent the sealing ring 253 from falling off from the notch portion 251. The connecting portion 2533 passes through the notch portion and connects the first arm 2531 with the second arm 2532. The connecting portion 2533 has a recessed arc-shaped surface. When the H-shaped members are snap-fitted to each other, their arc-shaped surfaces together enclose to form a hollow cavity to allow the wire to pass therethrough.

In a case where a plurality of wires passes through the notch portion 251, if the wires as a whole pass through the notch portion 251, since the cross section of the wires is circular, a gap formed between the wires will reduce the sealing performance. In this case, the arc-shaped surface of the connecting portion 2533 may be wavy (not shown) to form a plurality of independent hollow cavities in the mounted state to better seal the wires with a circular cross-section.

Figure 8:
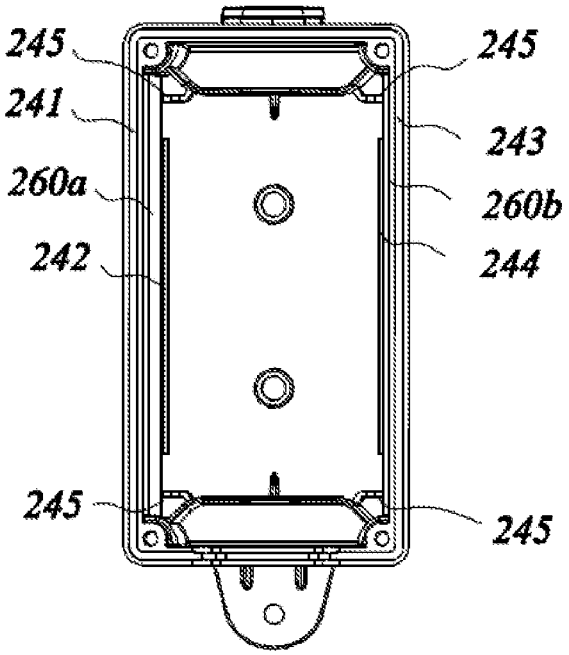
FIG. 8 is a top view of a lower sealing body in an embodiment of the present invention.

Referring to FIG. 8, a plurality of metal plates 260 are disposed in the sealed box 200, and the metal plates 260 are disposed between the vacuum pump 100 and the side walls of the sealed box 200. Since the metal plates 260 have a high density, they can block transmission of sound therethrough and achieve an effect of sound insulation and noise reduction.

Preferably, the metal plate 260 is an aluminum plate, a steel plate, or a galvanized plate.

Figure 9:
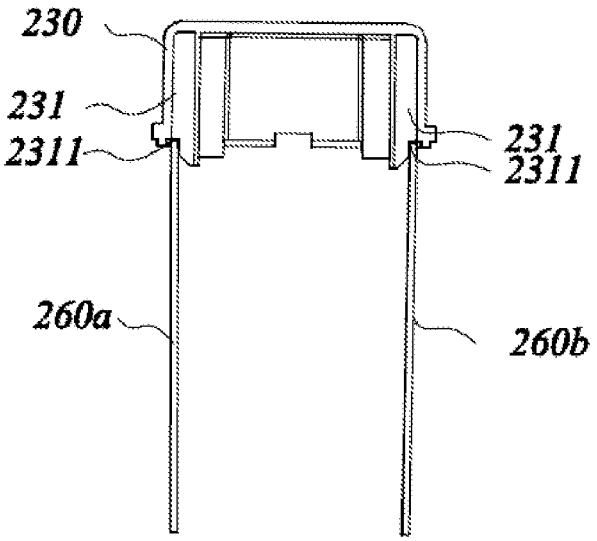
FIG. 9 is a schematic diagram of mounting an upper sealing body and a metal plate in an embodiment of the present invention.

Referring to FIG. 8 and FIG. 9, in an embodiment of the present invention, there are two metal plates 260 which are respectively attached to two opposite walls of the sealed box 200. The lower sealing body 240 and the upper sealing body 230 are respectively provided with a limiting structure to secure the metal plates 260*a* and 260*b*.

FIG. 8 shows that the bottom wall of the lower sealing body 240 is provided with a first rib 242 being parallel to a side wall 241 and spaced apart a distance d, and a second rib 244 being parallel to a side wall 243 and spaced apart a distance D, wherein the side wall 241 and the side wall 243 are opposed, d is the thickness of the metal plate 260*a*, and D is the thickness of the metal plate 260*b*. The spacing between the first rib 242 and the side wall 241 forms a limiting groove that limits the horizontal displacement of the metal plate 260*a*, and the spacing between the second rib 244 and the side wall 243 forms a limiting groove that limits the horizontal displacement of the metal plate 260*b*.

Figure 10:
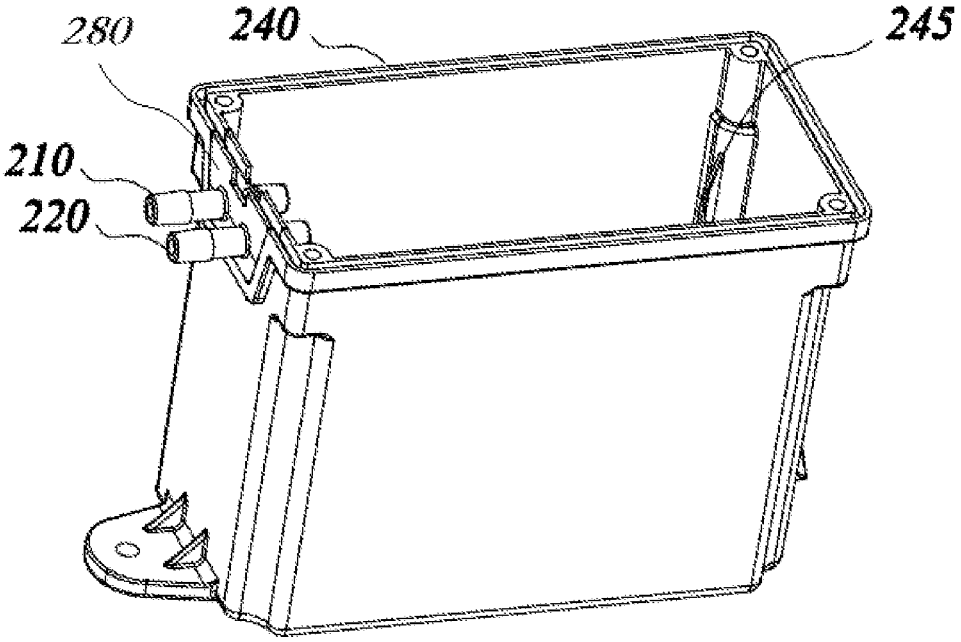
FIG. 10 is a schematic structural diagram of a lower sealing body in an embodiment of the present invention.

Referring to FIG. 8 and FIG. 10, the lower sealing body 240 is further provided with a plurality of guide grooves 245. The guide grooves 245 extend in a vertical direction and the extension direction is consistent with the insertion direction installing the metal plates 260. The guide grooves 245 guide the metal plates 260 to be mounted to preset positions.

FIG. 9 shows that the upper sealing body 230 is provided with a plurality of resisting members 231. When the upper sealing body 230 and the lower sealing body 240 are snap-fitted, the resisting member 231 againsts the top of the metal plate 260. A stepped portion 2311 is provided at an end of the resisting member 231 which is in contact with the metal plate 260. The stepped portion 2311 cooperates with the side walls of the upper sealing body 230 to form an inverted U-shaped space to accommodate the top of the metal plate 260. The top surface of the stepped portion 2311 againsts the top surface of the metal plate 260 and limits the displacement of the metal plate 260 in the vertical direction. The sides of the stepped portion abut against the sides of the metal plate 260 and limit the displacement of the metal plate 260 in the horizontal direction.

The metal plate 260 is disposed close to the side wall of the sealed box 200. The vibration of the vacuum pump 100 might cause resonance of the metal plate 260 to form new noise which is conducted externally through the walls of the sealed box 200. The above limiting structures strictly limit the position of the metal plates 260 to avoid resonating and generating noise.

In an embodiment of the present invention, a notch portion 251 is disposed on one of the upper sealing body 230 and lower sealing body 240, or on an engagement portion of the upper sealing body 230 and lower sealing body 240, to allow an air pipe assembly to pass therethrough.

Figure 11:
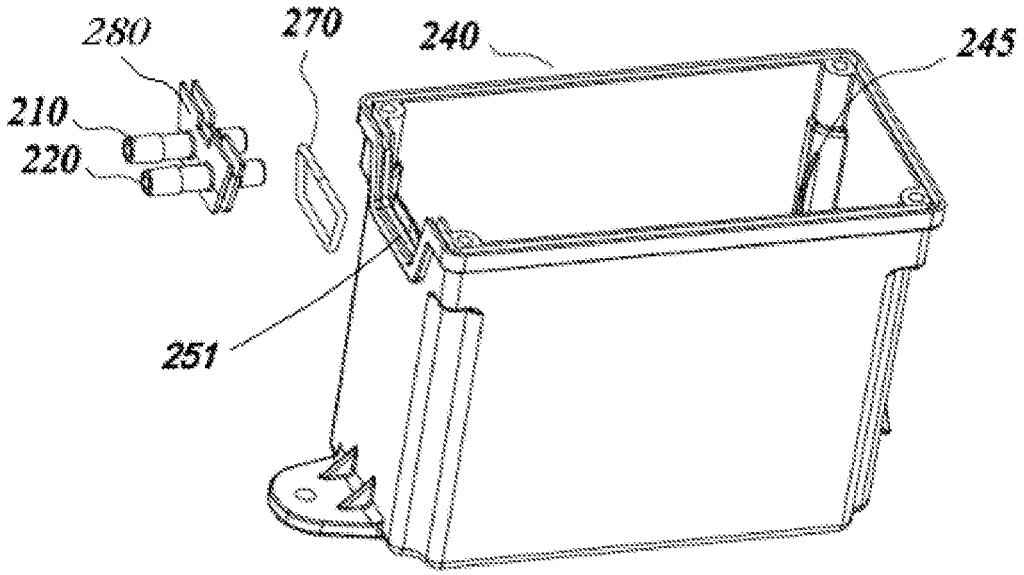
FIG. 11 is an exploded view of FIG. 10.

FIG. 10 and FIG. 11 exemplarily show a case where the notch portion 251 is provided on the lower sealing body 240. The notch portion 251 is provided on a side wall of the lower sealing body 240 close to the upper edge, and a groove is provided at peripheral edge of the notch portion 251 to receive a sealer 270 to ensure the airtightness of the sealed box 200. The sealer 270 has an annular structure made of an elastic material.

The air pipe assembly comprises an air inlet pipe 210, an air outlet pipe 220 and a base plate 280 that are integrally formed. The air inlet pipe 210 and the air outlet pipe 220 are disposed through the base plate 280, and an outer edge of the base plate 280 matches the shape of the notch portion 251. A groove is provided on the outer edge of the base plate 280 to mate with a flange on the periphery of the notch portion 251, the mating of the groove and the flange can clamp and secure the base plate 280 to the notch portion, and the sealer 270 is embedded at a gap between the groove and the flange.

The space of the cavity for receiving the vacuum pump 100 is compact and does not facilitate the operation of connecting and passing the air pipe line. It is possible to, by setting the air pipe assembly as an embedded mounting structure, conveniently embed and secure the air pipe assembly in the notch portion 251 after the air pipe assembly is connected with the vacuum pump 100, and then snap-fit the upper sealing body 230 and the lower sealing body 240 to complete the assembling.

Figure 12:
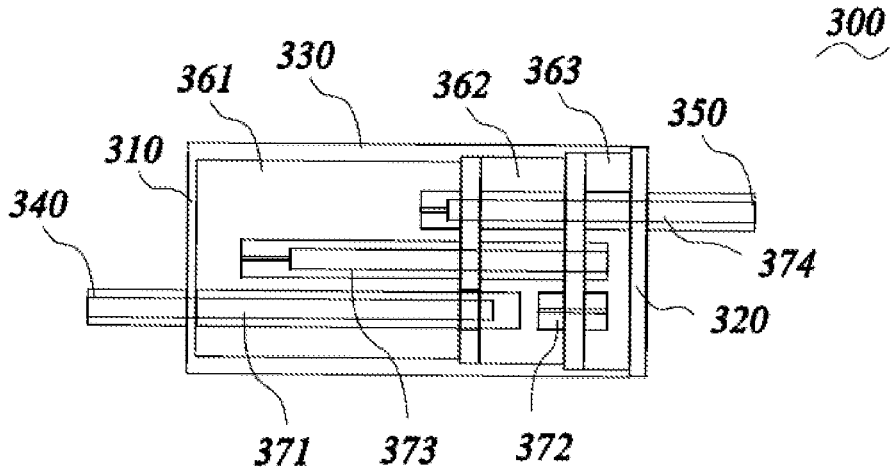
FIG. 12 is a perspective view of a muffler in an embodiment of the present invention.

The gas from the air outlet pipe 220 is exhausted to the outside of the refrigerator after being silenced. Referring to FIG. 1 and FIG. 12, in an embodiment of the present invention, the vacuum pump 100 is connected to the muffler 300 through the air outlet pipe 220. The muffler 300 comprises a housing. The housing is enclosed jointly by a first bottom surface 310 at a proximal end, a second bottom surface 320 at a distal end and a side wall 330 connecting the first bottom surface 310 with the second bottom surface 320 to form a cylindrical hollow cavity. The muffler 300 is provided at the proximal end with an air inlet 340 connected to the air outlet pipe 220, and provided with an air outlet 350 at the distal end. The interior of the cavity is divided into several chambers in an axial direction, the axial direction is the direction from the air inlet 340 to the air outlet 350, and at least part of the chambers has different volumes to correspondingly remove sounds at different frequency bands. Exemplarily, the volumes of respective chambers gradually decrease in the axial direction.

Preferably, there are three chambers, which are a first chamber 361, an intermediate chamber 362 and a second chamber 363 in turn from the proximal end to the distal end. The first chamber 361 is adjacent to the first bottom surface 310, the second chamber 363 is adjacent to the second bottom surface 320, and the intermediate cavity 362 is located between the first chamber 361 and the second chamber 363. A first duct 371 is communicated with the air inlet 340 and the intermediate chamber 362, a second duct 372 is communicated with the intermediate chamber 362 and the second chamber 363, a third duct 373 is communicated with the first chamber 361 and the second chamber 363, and a fourth duct 374 is communicated with the first chamber 361 and the air outlet 350.

There may be a plurality of intermediate chambers 362.

The shape of the housing of the muffler is not limited to a cylindrical shape, and may be set to a rectangular parallelepiped shape or an irregular shape.

Sound waves from the vacuum pump 100 pass through the first duct 371, the second duct 372, the third duct 373 and the fourth duct 374 in turn along with the airflow, and are reflected and refracted in turn in the intermediate chamber 362, the second chamber 363 and the first chamber 361 which have different volumes, and their energy is gradually dissipated. The muffling frequencies corresponding to the first chamber 361, the intermediate chamber 362 and the second chamber 363 are a low frequency, a medium frequency and a high frequency. In addition, the first duct 371, the second duct 372, the third duct 373 and the fourth duct 374 are provided with narrow inner diameters, so that partial energy of the sound waves is converted into thermal energy and dissipated when the sound waves pass through the ducts.

The muffler is arranged in a way that the sound waves travel in a path as long as possible in the muffler to reduce the energy and are reflected and refracted in different chambers, and a better muffling effect is achieved with a smaller muffler axial distance.

Figure 13:
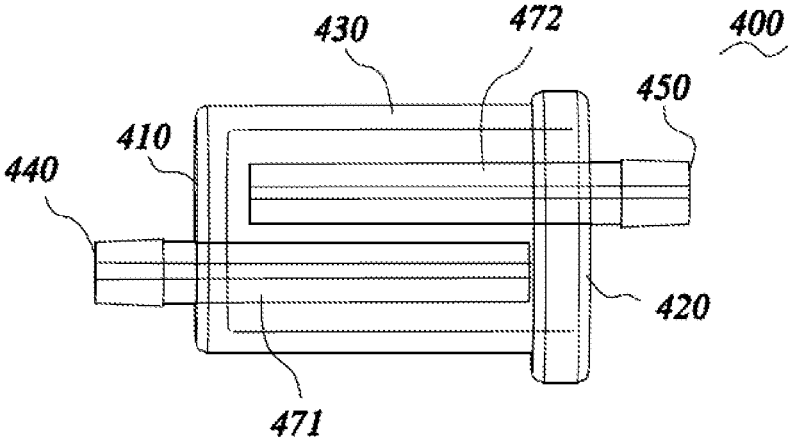
FIG. 13 is a perspective view of a muffler in another embodiment of the present invention.

Referring to FIG. 13, in a further embodiment of the present invention, the muffler 400 comprises a housing. The housing is enclosed jointly by a first bottom surface 410 at a proximal end, a second bottom surface 420 at a distal end, and a side wall 430 connecting the first bottom surface 410 with the second bottom surface 420 to form a cylindrical hollow cavity. A single chamber is formed in the cavity. The muffler 400 is provided with an air inlet 440 connected to the air outlet pipe 220 at the proximal end, and an air outlet 450 provided at the distal end. A first duct 471 is communicated with the air inlet 440 and the chamber, and a distal end of the first duct 471 is adjacent to the second bottom surface 420. A second duct 472 is communicated with the chamber and the air outlet 450, and a proximal end of the second duct 472 is adjacent to the first bottom surface 420.

The sound waves are reflected and refracted in the chamber, and the energy is gradually dissipated. The length of the first duct 471 and the second duct 472 is a quarter of a wavelength of a target audio to specifically eliminate the sound of the target audio. Preferably, a frequency of the target audio is 1000 Hz.

The first duct 471 and the second duct 472 are provided with narrow inner diameters, so that partial energy of the sound waves is converted into thermal energy and dissipated when the sound waves pass through the ducts.

In the noise generated by the vacuum pump 100 and conducted via gas, the high-frequency noise cannot be heard by human ears, and the noise causing interference to the user is mainly low-frequency noise. The present embodiment may purposefully eliminate low-frequency noise and make the structure of the muffler simpler.

Figure 14:
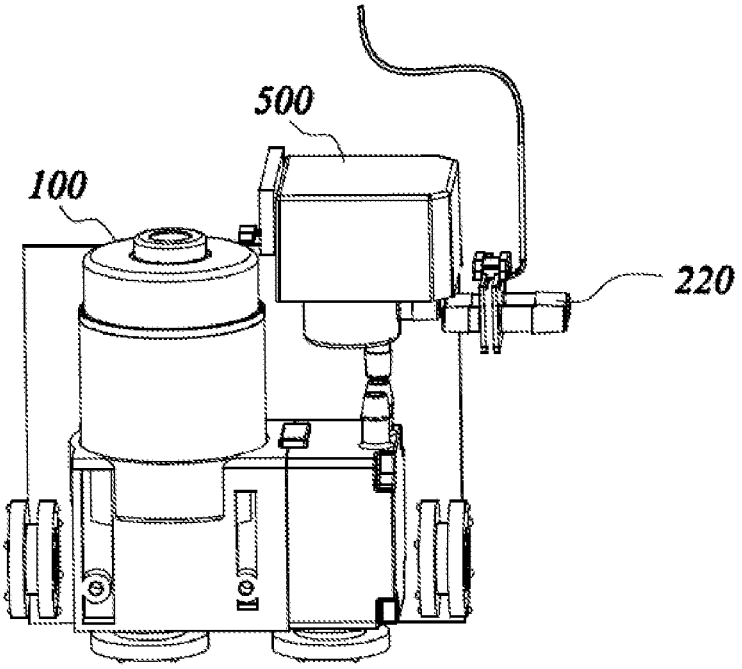
FIG. 14 is a schematic structural diagram of a vacuum pump and a muffler in a further embodiment of the present invention.
Figure 15:
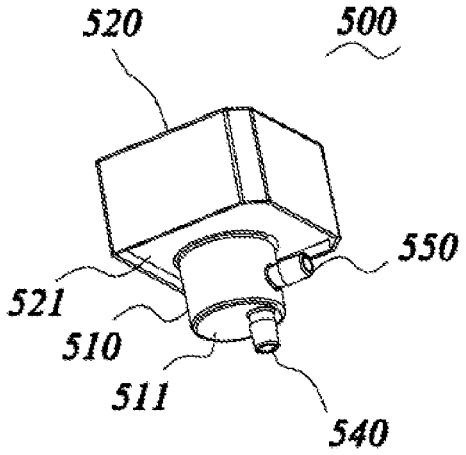
FIG. 15 is a schematic structural diagram of a muffler in a further embodiment of the present invention.

Referring to FIG. 14 and FIG. 15, in a further embodiment of the present invention, the muffler 500 is disposed inside the sealed box 200, and connects the exhaust line of the vacuum pump 100 and the air outlet pipe 220. The muffler 500 comprises a housing, and the housing is enclosed to form a hollow cavity for refraction and reflection of sound waves. The hollow cavity comprises a cylindrical chamber 510 and a rectangular parallelepiped chamber 520. One of bottom surfaces of the cylindrical chamber 510 is connected to one surface 521 of the rectangular parallelepiped chamber 520. The cylindrical chamber 510 is communicated with the interior of the rectangular parallelepiped chamber 520.

The diameter of the bottom surface of the cylindrical chamber 510 is less than or equal to a length of a side of a connecting surface 521 of the rectangular parallelepiped chamber 520.

The cylinder chamber 510 of the muffler 500 is provided with an air inlet 540 and an air outlet 550, and the air inlet 540 and the air outlet 550 are arranged at an angle so that the gas entering the hollow cavity reaches the outlet through reflected and refracted. During the process, the energy loses to achieve the muffling purpose.

Preferably, the air inlet 540 is disposed on the bottom surface 511 of the cylindrical chamber 510, and the air outlet 550 is disposed on a side of the cylindrical chamber 510.

The inner diameters of the air inlet 540 and the air outlet 550 are the same, so that the pressures at the two ports are balanced.

In the present embodiment, through the change of the shape of the hollow cavity, the sound waves are enabled to be reflected and refracted irregularly, and the energy is dissipated.

Figure 16:
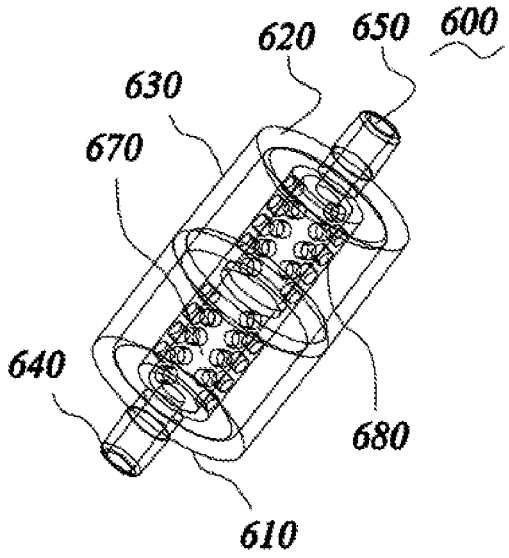
FIG. 16 is a perspective view of a muffler in a further embodiment of the present invention.
Figure 17:
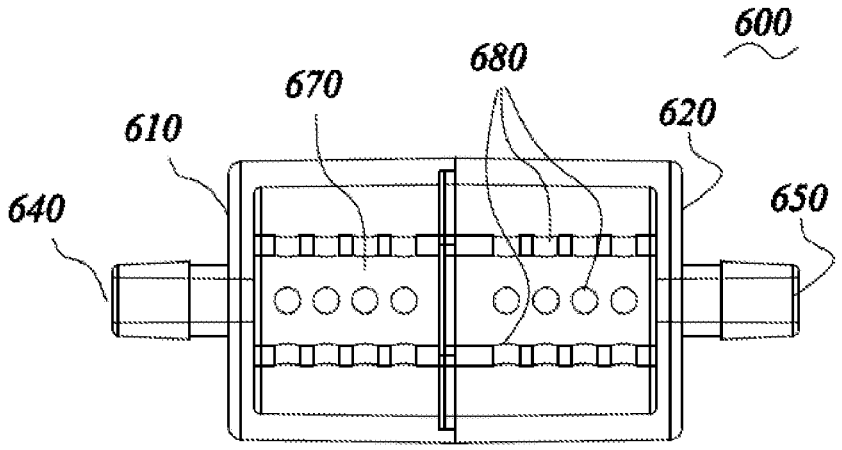
FIG. 17 is a schematic longitudinal sectional view of a muffler in a further embodiment of the present invention.

Referring to FIG. 16 and FIG. 17, in a further embodiment of the present invention, a muffler 600 comprises a housing, and the housing is enclosed to form a hollow cavity. The muffler 600 is provided with an air inlet 640 at a proximal end and an air outlet 650 at a distal end. The air inlet 640 and the air outlet 650 are communicated by a duct 670 provided in the housing. The duct 670 and the housing form a sleeve structure. The duct 670 is filled with a medium to absorb the vibrational energy of the sound waves and weaken the sound intensity. Furthermore, the medium is silencer cotton.

A plurality of through holes 680 are defined on the side wall of the duct 670, so that the duct 670 can implement communication with the cavity. The through holes 680 are distributed spaced apart in a circumferential direction of the sidewall of the duct 670, that is, the duct 670 defines through holes in a plurality of directions.

Preferably, the housing is enclosed jointly by a first bottom surface 610 at a proximal end, a second bottom surface 620 at a distal end, and a side wall 630 connecting the first bottom surface 610 with the second bottom surface 620 to form a cylindrical hollow cavity. The first bottom surface 610 is provided with an air inlet 640, and the second bottom surface 620 is provided with an air outlet 650.

Preferably, a diameter of the through holes is less than 1 mm.

Preferably, the cavity enclosed by the housing is divided into several chambers arranged from the proximal end to the distal end.

The sound waves from the vacuum pump 100 enter the duct 670 from the air inlet 640, and reach the air outlet 650 after being silenced by the medium. The sound waves at a specific frequency are attenuated and the sound intensity is weakened. During this process, partial sound waves, being diffracted by the through holes 680, enter the cavity, and are further attenuated after being refracted and reflected in the cavity.

The muffler is arranged in a way that the sound intensity is reduced through multiple channels by combining medium sound reduction with cavity sound reduction and be employing small holes to implement sound wave diffraction.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A sound-insulating refrigerator vacuum assembly, comprising a sealed box receiving a vacuum pump, wherein:

the sealed box body comprises an upper sealing body and a lower sealing body, the upper sealing body and the lower sealing body can be snap-fitted to define a receiving cavity, and the vacuum pump is placed in the receiving cavity;

the vacuum assembly further comprises an air pipe member, the air pipe member comprises an air inlet pipe, an air outlet pipe and a base plate that are integrally formed, and the air inlet pipe and the air outlet pipe are disposed through the base plate;

a notch portion is provided in the sealed box, and an outer edge of the base plate matches the notch portion in shape;

the vacuum pump is connected with a muffler;

a sealer is disposed between the notch portion and the base plate.

2. The sound-insulating refrigerator vacuum assembly according to claim 1, wherein the sealer is made of an elastic material.

3. The sound-insulating refrigerator vacuum assembly according to claim 1, wherein the sealer is ring-shaped.

4. The sound-insulating refrigerator vacuum assembly according to claim 1, wherein the muffler comprises a hollow cavity enclosed by a first bottom surface, a second bottom surface and a side wall, the side wall is connected with the first bottom surface and the second bottom surface, the muffler is provided with an air inlet at one end and with an air outlet at the other end, the cavity is divided into a plurality of chambers in an axial direction, the chambers comprise a first chamber adjacent to the first bottom surface, a second chamber adjacent to the second bottom surface and an intermediate chamber between the first chamber and the second chamber, the air inlet is in gas communication with the intermediate chamber, the intermediate chamber is in gas communication with the second chamber, the first chamber is in gas communication with the second chamber, and the air outlet is in gas communication with the first chamber.

5. The sound-insulating refrigerator vacuum assembly according to claim 1, wherein the muffler comprises a hollow cavity enclosed by a first bottom surface, a second bottom surface and a side wall, the side wall is connected with the first bottom surface and the second bottom surface, the first bottom surface is provided with an air inlet, the second bottom surface is provided with an air outlet, a first duct is communicated with the air inlet and the cavity, a second duct is communicated with the cavity and the air outlet, a distal end of the first duct is adjacent to the second bottom surface, and a proximal end of the second duct is adjacent to the first bottom surface.

6. The sound-insulating refrigerator vacuum assembly according to claim 1, wherein the muffler comprises a housing and a duct provided in the housing, the housing is enclosed to form a hollow cavity, the housing is provided with an air inlet at a proximal end and with an air outlet at a distal end, the duct communicates with the air inlet and the air outlet, the duct is filled with a medium, and a plurality of through holes are defined in the side wall of the duct to communicate the duct with the cavity.

7. A refrigerator comprising a cabinet, a fresh-keeping space being provided in the cabinet, wherein the refrigerator further comprises the vacuum assembly according to claim 1, and the vacuum assembly is connected with the fresh-keeping space.

8. The sound-insulating refrigerator vacuum assembly according to claim 1, wherein a flange is provided on a peripheral edge of the notch portion, a groove is provided on the outer edge of the base plate, and the flange mates with the groove.

9. The sound-insulating refrigerator vacuum assembly according to claim 8, wherein the sealer is disposed in a fitting gap between the flange and the groove.

* * * * *